US011014733B1

(12) United States Patent
Gause

(10) Patent No.: US 11,014,733 B1
(45) Date of Patent: May 25, 2021

(54) HERB TRAY WITH CONE FILLERS

(71) Applicant: Geneva Fund Partners, LLC, Denver, CO (US)

(72) Inventor: Marshall Gause, Thornton, CO (US)

(73) Assignee: Geneva Fund Partners, LLC, Denver, CO (US)

( * ) Notice: Subject to any disclaimer, the term of this patent is extended or adjusted under 35 U.S.C. 154(b) by 0 days.

(21) Appl. No.: 17/164,842

(22) Filed: Feb. 2, 2021

Related U.S. Application Data

(60) Provisional application No. 63/112,716, filed on Nov. 12, 2020.

(51) Int. Cl.

| | |
|---|---|
| ***B65D 71/00*** | (2006.01) |
| ***B65D 83/06*** | (2006.01) |
| ***B65D 1/34*** | (2006.01) |
| ***A61J 7/00*** | (2006.01) |

(52) U.S. Cl.
CPC ..... *B65D 83/06* (2013.01); *A61J 7/0069* (2013.01); *B65D 1/34* (2013.01); *B65D 2231/007* (2013.01)

(58) Field of Classification Search
CPC .... B65D 1/34; B65D 83/06; B65D 2231/007; A24C 5/02; A24C 5/42; A61J 7/0069; A61J 7/02
USPC ..... 206/236, 237, 242, 528, 540, 557; 131/70, 108, 329; 221/13
See application file for complete search history.

(56) References Cited

U.S. PATENT DOCUMENTS

| | | | | |
|---|---|---|---|---|
| 2,530,009 | A * | 11/1950 | Fields | A61J 7/02 222/129 |
| 5,927,488 | A * | 7/1999 | Gray | A24F 23/04 206/237 |
| 6,196,426 | B1 * | 3/2001 | White | A61J 7/02 222/462 |
| 8,770,400 | B2 * | 7/2014 | Connellan | A61J 7/02 206/223 |
| 9,241,877 | B2 * | 1/2016 | Burton | A61J 7/02 |
| 10,238,578 | B2 * | 3/2019 | Chessa | A61J 7/02 |
| 2014/0263389 | A1 * | 9/2014 | Perozek | A61J 7/02 221/1 |
| 2020/0236988 | A1 * | 7/2020 | Jarrett | A24F 15/18 |
| 2020/0281252 | A1 * | 9/2020 | Grochowski | A24C 5/42 |

* cited by examiner

*Primary Examiner* — Luan K Bui
(74) *Attorney, Agent, or Firm* — Tatonetti IP

(57) ABSTRACT

The present disclosure provides an herb tray for providing provision to facilitate cone fillers. The herb tray includes a constituent holding tray, a dispensing chamber, a primary spout, and a secondary dispenser. In addition, the dispensing chamber is attached to the constituent holding tray to hold a rolling paper cartridge against underside of a first ledge. Further, the primary spout is created by bottom and cover of the dispensing chamber. Furthermore, the secondary dispenser is attached to the constituent holding tray at the second dispensing side and is configured for dispensing the at least one of the plurality of constituents from the constituent holding tray into the at least one of the plurality of cone fillers. Moreover, the at least one of the plurality of cone fillers is attached to at least one of the primary spout and the secondary spout with facilitation of a cone holder.

8 Claims, 2 Drawing Sheets

HERB TRAY WITH CONE FILLERS

TECHNICAL FIELD

The present invention relates to the field of traditional manually operated tray, in particular, relates to an herb tray with cone fillers.

INTRODUCTION

People who take herbs often obtain their herbs in a small bottle/container filled. At the point of sale, the dispensation of herbs has several characteristics. Many herbs are stored in larger bulk quantities, and are then counted, packaged into smaller containers, labelled for use, and distributed to customers. The conventional tool for pouring herbs into bottle/container requires hand dexterity and the concentration of the user. Herbs moved in this way may often spill. To counter this, specialized tray is developed and known in the art. These trays often have one end from which it dispenses herbs into the container. Even these trays are difficult to handle and inconvenient to put herbs into the container. In addition, these trays are incapable to couple with herb fillers.

In light of the foregoing discussion, there exists a need for a new and improved tray with herbs filling mechanism which overcomes the above-cited drawbacks of conventional trays.

SUMMARY

In an aspect, the present disclosure provides an herb tray for providing provision to facilitate cone fillers. The herb tray includes a constituent holding tray, a dispensing chamber, a primary spout, and a secondary dispenser. In addition, the constituent holding tray having a substantially flat surface for holding at least one of a plurality of constituents. The constituent holding tray has a first dispensing side and a second dispensing side. Further, the dispensing chamber is attached to the constituent holding tray at the first dispensing side to hold a rolling paper cartridge against underside of a first ledge to allow the plurality of constituents to be dispensed into open end of the rolling paper cartridge. Furthermore, the primary spout is created by bottom and cover of the dispensing chamber. The primary spout has a closed end on opposite end of the dispensing chamber. The closed end prevents the plurality of constituents and the rolling paper cartridge in the dispensing chamber from pouring out when the herb tray is lifted and tilted to pour the plurality of constituents and the rolling paper cartridge into at least one of a plurality of cone fillers. Moreover, the secondary dispenser is attached to the constituent holding tray at the second dispensing side. The secondary dispenser having a top surface, a top wall, a side wall that angles toward the top wall to create a secondary spout, and an underside. The secondary dispenser is configured for dispensing the at least one of the plurality of constituents from the constituent holding tray into the at least one of the plurality of cone fillers. Also, the at least one of the plurality of cone fillers is attached to at least one of the primary spout and the secondary spout with facilitation of a cone holder to be filled with the at least one of the plurality of constituents by lifting and tilting the herb tray.

In an embodiment of the present disclosure, the herb tray further includes a fastening element. In addition, the fastening element the first element is made up of a first material selected from a first group of materials includes rubber, natural rubber, neoprene rubber, silicone rubber, nitrile rubber, ethylene propylene diene monomer rubber, styrene-butadiene rubber, butyl rubber, fluorosilicone rubber, synthetic rubber, glass, acrylonitrile butadiene styrene, polyethylene terephthalate, polyethylene, polyvinyl chloride, polypropylene, polylactic acid, polycarbonate, acrylic, polyoxymethylene, plastic, metallic materials, alloys, composites, nylon, silicon, and wood.

In an embodiment of the present disclosure, the plurality of constituents includes herbs, spices, flowers, plants, seeds, and leaves, comprise coffee, tea, and tobacco.

In an embodiment of the present disclosure, the cone holder is made up of a second material selected from a second group of materials includes acrylonitrile butadiene styrene, metallic materials, alloys, polyethylene terephthalate, polyethylene, polyvinyl chloride, polypropylene, polylactic acid, polycarbonate, acrylic, polyoxymethylene, and plastic.

In an embodiment of the present disclosure, the cone holder has a thread on either end of the cone holder. In addition, the thread is selected from a group of threads includes right-hand threads, left-hand threads, taper threads, "V" shape threads, square threads, acme threads, buttress threads, knuckle threads, and worm threads.

In an embodiment of the present disclosure, the herb tray further includes a chamber lid. In addition, the chamber lid is attached to the dispensing chamber by means of a hinge. Further, the chamber lid holds the plurality of constituents when the herb tray is lifted and tilted for gravity feed.

In an embodiment of the present disclosure, the herb tray further includes at least one closing plug. In addition, the at least one closing plug enables a user to close the primary spout and the secondary spout while non-usage. Further, the at least one closing plug is made up of a third material selected from a third group of materials includes rubber, natural rubber, neoprene rubber, silicone rubber, nitrile rubber, ethylene propylene diene monomer rubber, styrene-butadiene rubber, butyl rubber, fluorosilicone rubber, synthetic rubber, glass, acrylonitrile butadiene styrene, polyethylene terephthalate, polyethylene, polyvinyl chloride, polypropylene, polylactic acid, polycarbonate, acrylic, polyoxymethylene, plastic, metallic materials, alloys, composites, nylon, silicon, and wood.

In an embodiment of the present disclosure, the herb tray further includes the first ledge and a second ledge. In addition, the first ledge overhangs from the first dispensing side by about 1.5 millimeter. Further, the first ledge has a thickness of about 1 millimeter. Furthermore, the second ledge seals region of the primary spout of the dispensing chamber.

BRIEF DESCRIPTION OF THE DRAWINGS

Figure 1:
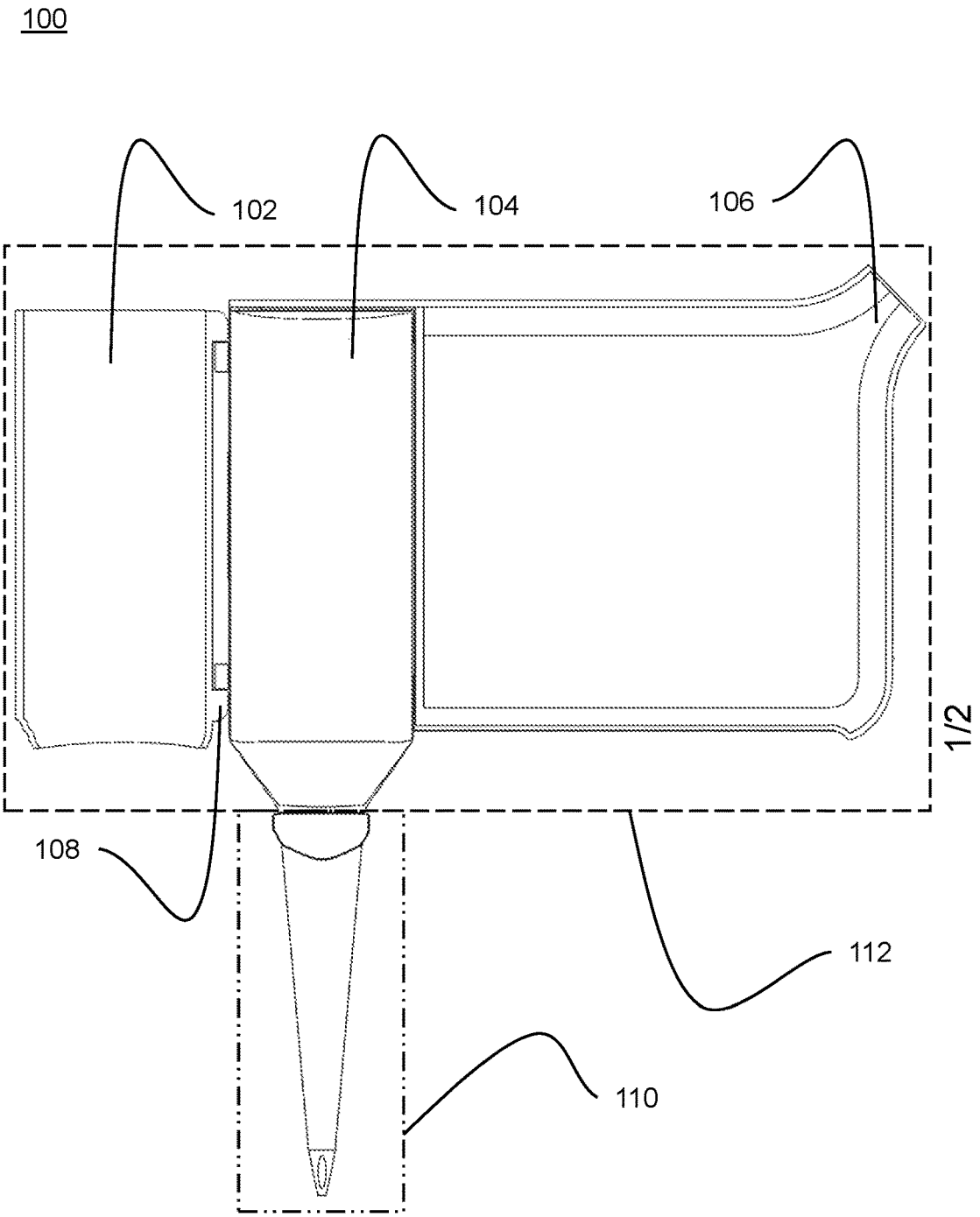
Figure 2:
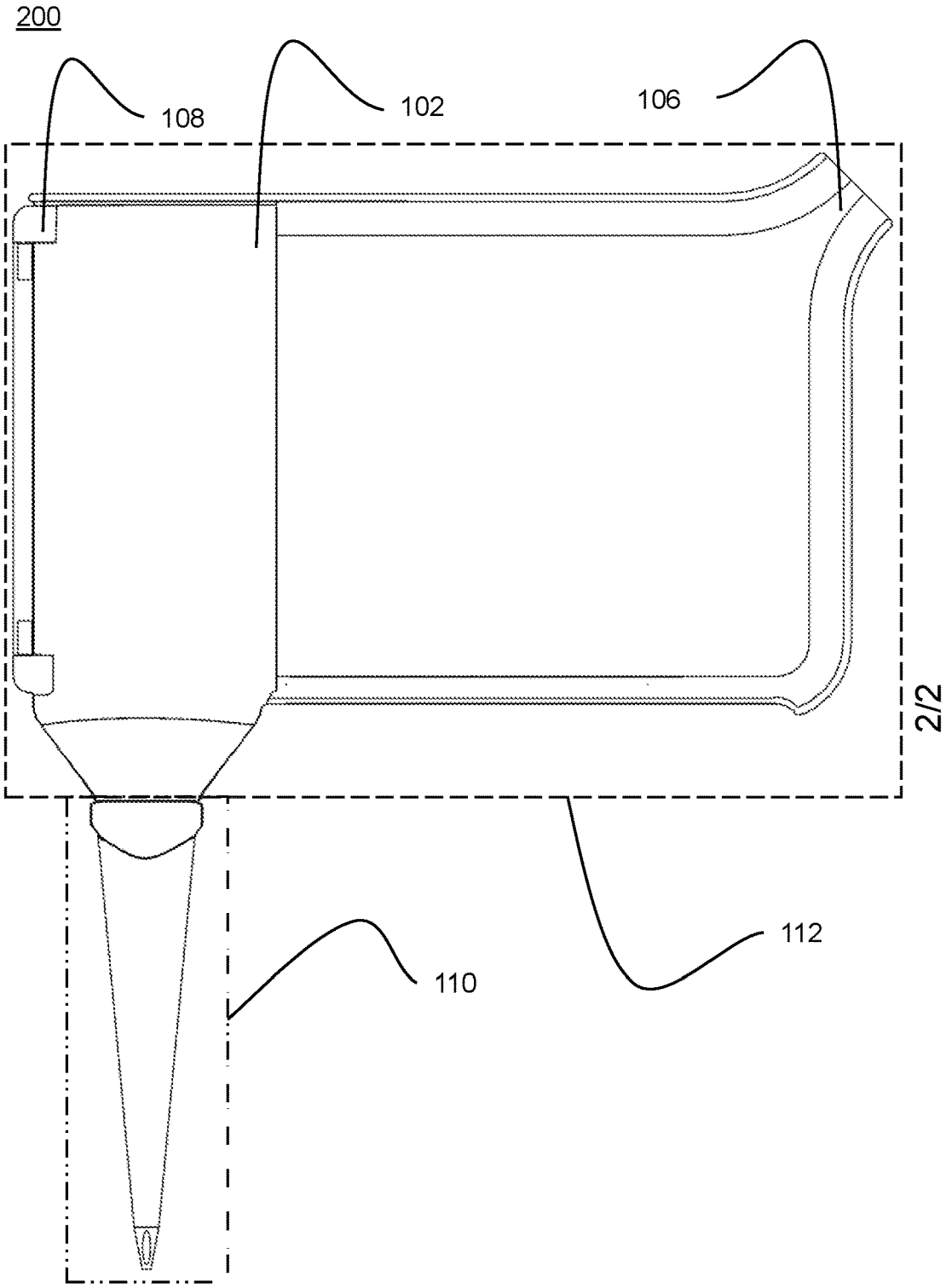

Having thus described the invention in general terms, reference will now be made to the accompanying drawings, which are not necessarily drawn to scale, and wherein:

FIG. 1 illustrates a first top view of an herb tray having a chamber lid that is open, in accordance with various embodiment of the present disclosure; and FIG. 2 illustrates a second top view of the herb tray having the chamber lid that is close, in accordance with various embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

In the following description, for purposes of explanation, numerous specific details are set forth in order to provide a thorough understanding of the present technology. It will be apparent, however, to one skilled in the art that the present technology can be practiced without these specific details. In other instances, structures and devices are shown in block diagram form only in order to avoid obscuring the present technology.

Reference in this specification to "one embodiment" or "an embodiment" means that a particular feature, structure, or characteristic described in connection with the embodiment is included in at least one embodiment of the present technology. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Reference will now be made in detail to selected embodiments of the present disclosure in conjunction with accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figures are intended and provided to illustrate embodiments of the disclosure described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

FIG. 1 illustrates a first top view 100 of an herb tray 112 having a chamber lid 102 that is open, in accordance with various embodiment of the present disclosure. FIG. 2 illustrates a second top view 200 of the herb tray 112 having the chamber lid 102 that is close, in accordance with various embodiment of the present disclosure. The herb tray 112 includes a constituent holding tray, a dispensing chamber 104, a primary spout and a secondary dispenser. The above stated elements of the herb tray 112 operate coherently and synchronously to enable the herb tray 112 for providing provision to facilitate a plurality of cone fillers 110.

The herb tray 112 is made up of a material selected from a group of materials consisting clear plastics, injection molded plastic, polycarbonate, injection molded acrylic, hand-crafted acrylic, injection molded polystyrene, thermoplastic polymer, acrylic sheets, silicon dioxide based glass, soda-lime based glass, borosilicate glasses, aluminosilicate glass, non-crystalline glass, fiberglass, and the like. In an embodiment of the present disclosure, the herb tray 112 may be placed on a LED coaster that facilitates lightening of the herb tray 112. In addition, the light travels through the herb tray 112 allowing the herb tray 112 to illuminate. Further, the LED coaster is placed underneath a logo in center of the herb tray 112 so the light does not shine directly up but disperses throughout the herb tray 112. In another embodiment of the present disclosure, the herb tray 112 may be illuminated through any of lighted accents, lighted strips or glow in dark lighted strips. In an example, the herb tray 112 glows in the dark due to the LED coaster placed underneath the herb tray 112. In another example, the herb tray 112 glows in the dark due to the lighted accents. In yet another example, the herb tray 112 glows in the dark due to the lighted strips.

The constituent holding tray has a substantially flat surface to hold at least one of a plurality of constituents. In addition, the constituent holding tray has a first dispensing side and a second dispensing side. In an embodiment of the present disclosure, the constituent holding tray has a flat surface. In another embodiment of the present disclosure, the constituent holding tray has any suitable surface. In an embodiment of the present disclosure, the constituent holding tray has a shape of rectangle. In another embodiment of the present disclosure, the constituent holding tray has the shape of square. In yet another embodiment of the present disclosure, the constituent holding tray has the shape of circle. In yet another embodiment of the present disclosure, the constituent holding tray has any other suitable shape.

The constituent holding tray has the substantially flat surface on which the plurality of constituents is disposed. The constituent holding tray has the second dispensing side, which is on right hand side located near connection to incline/decline funnel. The constituent holding tray has the first dispensing side, which is located on left near the dispensing chamber 104. In addition, the constituent holding tray further has a front edge and a rear wall. The front edge is flat with the substantially flat surface, which allows a user (the word used throughout to describe a person using the herb tray 112) to dispense the plurality of constituents by means of a brush. Further, the rear wall prevents the plurality of constituents from sliding off back portion of the substantially flat surface. The constituent holding tray can come in many different sizes depending upon the needs of the users, but will generally be roughly in a range from 6 to 12 inches wide and roughly 4 to 10 inches deep. In an embodiment of the present disclosure, the constituent holding tray is made from mold of appropriate geometric configurations.

The dispensing chamber 104 is attached to the constituent holding tray at the first dispensing side to hold a rolling paper cartridge against underside of a first ledge to allow the plurality of constituents to be dispensed into open end of the rolling paper cartridge. In addition, the plurality of constituents include but may not be limited to herbs, spices, flowers, plants, seeds, and leaves, comprise coffee, tea, and tobacco. In an embodiment of the present disclosure, the first ledge overhangs from the first dispensing side by about 1.5 millimeter. In another embodiment of the present disclosure, the overhanging distance of the first ledge from the first dispensing side may vary. In an embodiment of the present disclosure, the first ledge has a thickness of about 1 millimeter. In another embodiment of the present disclosure, the thickness of the first ledge may vary.

The dispensing chamber 104 located on left side of the constituent holding tray. The dispensing chamber 104 consists of a chamber bottom, and the chamber lid 102. In an embodiment of the present disclosure, the chamber bottom is moulded with same piece of material as the constituent holding tray. In another embodiment of the present disclosure, the chamber bottom is moulded with different piece of material as the constituent holding tray. In addition, the chamber lid 102 is attached to the dispensing chamber 104 by means of a hinge. Further, the chamber lid 102 holds the plurality of constituents when the herb tray 112 is lifted and tilted for gravity feed. Furthermore, the hinge is of a standard and well known type, and consists of at least two small tubes mounted on the chamber bottom and at least two small tubes mounted on the chamber lid 102 such that interior bore of tubes align, and a chamber pin that is securely inserted into the tubes to create the hinge.

The chamber lid 102 rotates about the hinge to cover the dispensing chamber 104. When closed (as shown in FIG. 2), the chamber lid 102 and the chamber bottom create the dispensing chamber 104, which is a hollow cylindrical tube designed for holding the rolling paper cartridge and the plurality of constituents, and then dispensing them into the at least one of the plurality of cone fillers 110. The chamber bottom and the chamber lid 102 have beveled ends to create the primary spout. In an embodiment of the present disclosure, the chamber lid 102 is an optional chamber lid.

The primary spout is created by the chamber bottom and the chamber lid 102 of the dispensing chamber 104. In addition, the primary spout has a closed end on opposite end of the dispensing chamber 104. Further, the closed end prevents the plurality of constituents and the rolling paper cartridge in the dispensing chamber 104 from pouring out when the herb tray 112 is lifted and tilted to pour the plurality of constituents and the rolling paper cartridge into the at least one of the plurality of cone fillers 110. The primary spout is sized to couple easily with the at least one of the plurality of cone fillers 110, which allows the plurality of constituents and the rolling paper cartridge from the dispensing chamber 104 to be easily dispensed into the at least one of the plurality of cone fillers 110.

The herb tray 112 includes the secondary dispenser. The secondary dispenser is attached to the constituent holding tray at the second dispensing side. In addition, the secondary dispenser have a top surface, a top wall, a side wall that angles toward the top wall to create the secondary spout 106, and an underside. Further, the secondary dispenser is configured for dispensing the at least one of the plurality of constituents from the constituent holding tray into the at least one of the plurality of cone fillers 110. Furthermore, the at least one of the plurality of cone fillers 110 is attached to at least one of the primary spout and the secondary spout 106 with facilitation of a cone holder to be filled with the at least one of the plurality of constituents by lifting and tilting the herb tray 112.

The herb tray 112 further includes a fastening element. In addition, the fastening element enables the cone holder and the primary spout to ensure non-spillage. Further, the fastening element is made up of a first material selected from a first group of materials consisting rubber, natural rubber, neoprene rubber, silicone rubber, nitrile rubber, ethylene propylene diene monomer rubber, styrene-butadiene rubber, butyl rubber, fluorosilicone rubber, synthetic rubber, glass, acrylonitrile butadiene styrene, polyethylene terephthalate, polyethylene, polyvinyl chloride, polypropylene, polylactic acid, polycarbonate, acrylic, polyoxymethylene, plastic, metallic materials, alloys, composites, nylon, silicon, and wood.

The cone holder is made up of a second material selected from a second group of materials consisting acrylonitrile butadiene styrene, metallic materials, alloys, polyethylene terephthalate, polyethylene, polyvinyl chloride, polypropylene, polylactic acid, polycarbonate, acrylic, polyoxymethylene, and plastic. In addition, the cone holder has a thread on either end of the cone holder. Further, the thread is selected from a group of threads consisting right-hand threads, left-hand threads, taper threads, "V" shape threads, square threads, acme threads, buttress threads, knuckle threads, and worm threads.

The herb tray 112 further includes at least one closing plug. In addition, the at least one closing plug enables the user to close the primary spout and the secondary spout 106 while non-usage. Further, the at least one closing plug is made up of a third material selected from a third group of materials consisting rubber, natural rubber, neoprene rubber, silicone rubber, nitrile rubber, ethylene propylene diene monomer rubber, styrene-butadiene rubber, butyl rubber, fluorosilicone rubber, synthetic rubber, glass, acrylonitrile butadiene styrene, polyethylene terephthalate, polyethylene, polyvinyl chloride, polypropylene, polylactic acid, polycarbonate, acrylic, polyoxymethylene, plastic, metallic materials, alloys, composites, nylon, silicon, and wood.

Each of the plurality of cone fillers 110 includes at least one filler tube of the plurality of cone fillers 110. In an embodiment of the present disclosure, number of the at least one filler tube used for the plurality of cone fillers 110 is 1. In another embodiment of the present disclosure, number of the at least one filler tube used for the plurality of cone fillers 110 is 2. In yet another embodiment of the present disclosure, number of the at least one filler tube used for the plurality of cone fillers 110 may vary. In addition, the at least one filler tube corresponds to a hollow tube that may hold the rolling paper cartridge to contain the plurality of constituents. Further, the at least one filler tube may be called as funnel. Furthermore, the at least one filler tube is a tube or pipe that is wide at top and narrow at bottom, used for guiding liquid or powder of at least one of the plurality of constituents the into a small opening.

The at least one filler tube has a hole and a rolling paper cartridge holder at the bottom of the at least one filler tube. In an embodiment of the present disclosure, the rolling paper cartridge holder corresponds to a U-shaped rolling paper cartridge holder. In another embodiment of the present disclosure, the rolling paper cartridge holder corresponds to a V-shaped rolling paper cartridge holder. In yet another embodiment of the present disclosure, the rolling paper cartridge holder corresponds to a Y-shaped rolling paper cartridge holder. In yet another embodiment of the present disclosure, the rolling paper cartridge holder corresponds to a W-shaped rolling paper cartridge holder.

In an embodiment of the present disclosure, the at least one filler tube used for the plurality of cone fillers 110 has a length of about 92 millimeters. In another embodiment of the present disclosure, the length of the at least one filler tube used for the plurality of cone fillers 110 may vary. In an embodiment of the present disclosure, the narrow end of the at least one filler tube used for the plurality of cone fillers 110 has an outer diameter of about 7 millimeters. In another embodiment of the present disclosure, the outer diameter of the narrow end of the at least one filler tube used for the plurality of cone fillers 110 may vary. In an embodiment of the present disclosure, the narrow end of the at least one filler tube used for the plurality of cone fillers 110 has an inner diameter of about 5 millimeters. In another embodiment of the present disclosure, the inner diameter of the narrow end of the at least one filler tube used for the plurality of cone fillers 110 may vary.

In an embodiment of the present disclosure, the wide end of the at least one filler tube used for the plurality of cone fillers 110 has an outer diameter of about 18 millimeters. In another embodiment of the present disclosure, the outer diameter of the wide end of the at least one filler tube used for the plurality of cone fillers 110 may vary. In an embodiment of the present disclosure, the wide end of the at least one filler tube used for the plurality of cone fillers 110 has an inner diameter of about 16 millimeters. In another embodiment of the present disclosure, the inner diameter of the wide end of the at least one filler tube used for the plurality of cone fillers 110 may vary. In an embodiment of the present disclosure, the at least one filler tube used for the plurality of cone fillers 110 has a thickness of about 2 millimeters throughout the length of the at least one filler tube. In another embodiment of the present disclosure, the thickness of the at least one filler tube used for the plurality of cone fillers 110 may vary.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

I claim:

1. An herb tray for providing provision to facilitate cone fillers, the herb tray comprising:

a constituent holding tray having a substantially flat surface for holding at least one of a plurality of constituents, wherein the constituent holding tray has a first dispensing side and a second dispensing side;

a dispensing chamber attached to the constituent holding tray at the first dispensing side to hold a rolling paper cartridge against underside of a first ledge to allow the plurality of constituents to be dispensed into open end of the rolling paper cartridge;

a primary spout created by bottom and cover of the dispensing chamber, wherein the primary spout has a closed end on opposite end of the dispensing chamber, wherein the closed end prevents the plurality of constituents and the rolling paper cartridge in the dispensing chamber from pouring out when the herb tray is lifted and tilted to pour the plurality of constituents and the rolling paper cartridge into at least one of a plurality of cone fillers; and a secondary dispenser attached to the constituent holding tray at the second dispensing side, wherein the secondary dispenser having a top surface, a top wall, a side wall that angles toward the top wall to create a secondary spout, and an underside, wherein the secondary dispenser is configured for dispensing the at least one of the plurality of constituents from the constituent holding tray into the at least one of the plurality of cone fillers, wherein the at least one of the plurality of cone fillers is attached to at least one of the primary spout and the secondary spout with facilitation of a cone holder to be filled with the at least one of the plurality of constituents by lifting and tilting the herb tray.

2. The herb tray as recited in claim 1, wherein the herb tray further comprises a fastening element, wherein the fastening element enables the cone holder and the primary spout to ensure non-spillage, wherein the fastening element is made up of a first material selected from a first group of materials comprising rubber, natural rubber, neoprene rubber, silicone rubber, nitrile rubber, ethylene propylene diene monomer rubber, styrene-butadiene rubber, butyl rubber, fluorosilicone rubber, synthetic rubber, glass, acrylonitrile butadiene styrene, polyethylene terephthalate, polyethylene, polyvinyl chloride, polypropylene, polylactic acid, polycarbonate, acrylic, polyoxymethylene, plastic, metallic materials, alloys, composites, nylon, silicon, and wood.

3. The herb tray as recited in claim 1, wherein the plurality of constituents comprising herbs, spices, flowers, plants, seeds, and leaves, comprise coffee, tea, and tobacco.

4. The herb tray as recited in claim 1, wherein the cone holder is made up of a second material selected from a second group of materials comprising acrylonitrile butadiene styrene, metallic materials, alloys, polyethylene terephthalate, polyethylene, polyvinyl chloride, polypropylene, polylactic acid, polycarbonate, acrylic, polyoxymethylene, and plastic.

5. The herb tray as recited in claim 1, wherein the cone holder has a thread on either end of the cone holder, wherein the thread is selected from a group of threads comprising right-hand threads, left-hand threads, taper threads, "V" shape threads, square threads, acme threads, buttress threads, knuckle threads, and worm threads.

6. The herb tray as recited in claim 1, wherein the herb tray further comprises a chamber lid, wherein the chamber lid is attached to the dispensing chamber by means of a hinge, wherein the chamber lid holds the plurality of constituents when the herb tray is lifted and tilted for gravity feed.

7. The herb tray as recited in claim 1, wherein the herb tray further comprises at least one closing plug, wherein the at least one closing plug enables a user to close the primary spout and the secondary spout while non-usage, wherein the at least one closing plug is made up of a third material selected from a third group of materials comprising rubber, natural rubber, neoprene rubber, silicone rubber, nitrile rubber, ethylene propylene diene monomer rubber, styrene-butadiene rubber, butyl rubber, fluorosilicone rubber, synthetic rubber, glass, acrylonitrile butadiene styrene, polyethylene terephthalate, polyethylene, polyvinyl chloride, polypropylene, polylactic acid, polycarbonate, acrylic, polyoxymethylene, plastic, metallic materials, alloys, composites, nylon, silicon, and wood.

8. The herb tray as recited in claim 1, wherein the herb tray further comprises the first ledge and a second ledge, wherein the first ledge overhangs from the first dispensing side by about 1.5 millimetre, wherein the first ledge has a thickness of about 1 millimetre, wherein the second ledge seals region of the primary spout of the dispensing chamber.

* * * * *